US011878836B2

(12) United States Patent
Meager

(10) Patent No.: US 11,878,836 B2
(45) Date of Patent: Jan. 23, 2024

(54) PRESSURE EQUALIZATION APPARATUS FOR A CONTAINER AND METHODS ASSOCIATED THEREWITH

(71) Applicant: PAHA DESIGNS, LLC, Felt, ID (US)

(72) Inventor: Benjamin Meager, Felt, ID (US)

(73) Assignee: PAHA DESIGNS, LLC, Felt, ID (US)

( * ) Notice: Subject to any disclaimer, the term of this patent is extended or adjusted under 35 U.S.C. 154(b) by 586 days.

(21) Appl. No.: 16/707,769

(22) Filed: Dec. 9, 2019

(65) Prior Publication Data

US 2020/0216237 A1 Jul. 9, 2020

Related U.S. Application Data

(60) Provisional application No. 62/777,442, filed on Dec. 10, 2018.

(51) Int. Cl.

| | |
|---|---|
| ***B65D 17/50*** | (2006.01) |
| ***B65D 17/28*** | (2006.01) |
| ***B65D 17/34*** | (2006.01) |
| ***B65D 17/00*** | (2006.01) |
| ***B65D 51/16*** | (2006.01) |
| ***B65D 53/08*** | (2006.01) |
| ***B65D 77/20*** | (2006.01) |

(52) U.S. Cl.

CPC ..... *B65D 17/502* (2013.01); *B65D 17/02* (2013.01); *B65D 17/06* (2013.01); *B65D 17/34* (2018.01); *B65D 17/4011* (2018.01); *B65D 51/1677* (2013.01); *B65D 53/08* (2013.01); *B65D 77/2024* (2013.01); *B65D 2517/0094* (2013.01); *B65D 2517/5083* (2013.01); *B65D 2577/205* (2013.01)

(58) Field of Classification Search

CPC ..... B65D 17/502; B65D 17/02; B65D 17/06; B65D 53/08; B65D 2517/0094; B65D 2517/5083

USPC ..... 220/270, 359.2, 367.1

See application file for complete search history.

(56) References Cited

U.S. PATENT DOCUMENTS 3,251,515 A * 5/1966 Henchert ..... B65D 17/28 222/487
3,302,818 A * 2/1967 Balocca ..... B65D 17/505 229/125.09
3,780,899 A * 12/1973 Roper ..... B65D 7/46 220/4.04
4,708,257 A * 11/1987 Deline ..... B65D 51/20 220/258.2

(Continued)

FOREIGN PATENT DOCUMENTS

WO 2018169877 A1 9/2018

OTHER PUBLICATIONS

International Search Report and Written Opinion of related PCT/US2019/065405. dated Feb. 4, 2020. 8 pages.

*Primary Examiner* — James N Smalley
(74) *Attorney, Agent, or Firm* — FisherBroyles, LLP; Craig W. Mueller

(57) ABSTRACT

A device is provided that assists with equalizing air pressure within a container with the atmospheric air pressure as liquid is being poured from the container and includes one or more relatively short air tubes. The device is provided with the ability to simultaneously equalize pressure in the container while also providing a drip collection mechanism. The device may be configured for unidirectional pouring or multi-directional pouring.

16 Claims, 13 Drawing Sheets

(56) References Cited

U.S. PATENT DOCUMENTS

| | | | |
|---|---|---|---|
| 5,275,679 | A | 1/1994 | Rojek |
| 5,688,544 | A | 11/1997 | Bolton et al. |
| 6,012,596 | A | 1/2000 | Oglesbee et al. |
| 8,602,235 | B2 | 12/2013 | Meager |
| 8,684,205 | B2 | 4/2014 | Meager |
| 8,857,639 | B2 | 10/2014 | Meager |
| 9,796,506 | B2 | 10/2017 | Meager |
| 2004/0060892 | A1 | 4/2004 | Heston et al. |
| 2011/0089174 | A1 | 4/2011 | Smith et al. |

* cited by examiner

PRESSURE EQUALIZATION APPARATUS FOR A CONTAINER AND METHODS ASSOCIATED THEREWITH

This application claims the benefit of U.S. Provisional Patent Application Ser. No. 62/777,442, filed Dec. 10, 2018, the entirety of which is incorporated by reference herein.

This application is also related to PCT Application Serial No. PCT/US18/022034, filed Mar. 12, 2018, which claims the benefit of U.S. Provisional Patent Application Ser. No. 62/470,742, filed Mar. 13, 2017, and entitled "Breathable Container with Integrated Drip Collection,"; U.S. Provisional Patent Application Ser. No. 62/511,222, filed May 25, 2017, and entitled "Pressure Equalization Apparatus for a Container and Methods Associated Therewith," and U.S. Provisional Patent Application Ser. No. 62/562,886, filed Sep. 25, 2017, and entitled "Pressure Equalization Apparatus for a Container and Methods Associated Therewith," which are incorporated by reference in their entirety herein.

FIELD

Embodiments of the present invention are generally related to a device that at least partially equalizes air pressure within a container with atmospheric air pressure as fluid is poured from the container.

SUMMARY

Most will appreciate that flow from a container is often erratic and uneven. This "gurgling" effect is caused by a pressure imbalance between atmospheric pressure outside the container and the container's internal pressure. Existing devices for addressing the pressure differential do not address related issues, such as pour-related dripping. Accordingly, there is a need for a device that enhances fluid flow from a container that is simple to use, cost-effective to manufacture, and can be retrofitted onto existing container end designs.

It is one aspect of some embodiments of the present invention to provide a container end closure that facilitates fluid egress from a container. More specifically, an end closure is provided that is comprised of a center panel interconnected to a chuck wall. The center panel may be connected to the chuck wall by way of a countersink, a configuration found in many common beverage containers. Those of ordinary skill in the art will appreciate that embodiments of the present invention are not limited to that type of container. The center panel includes a fluid opening with an air opening spaced therefrom, wherein air enters the container to compensate for the pressure drop associated with the exiting fluid during the pouring process. Air ingress into the container is maximized by providing an air channel, a concept described in the patent applications listed above. In the embodiments described herein the air channel is created by an indentation in the center panel that communicates with an aperture that leads into the fluid container. In one embodiment, the fluid opening is circular with a diameter of about 8 mm-20 mm in spaced about 50-90 mm from the circular air opening that has a diameter of about 2.5 mm-5 mm in. Ideally, the fluid and air openings are separated to the greatest extend possible.

In one embodiment, the air opening and fluid opening are closed by a selectively-removable member, e.g., a sticker. Removal of the sticker allows fluid to exit and air to enter the container and, thus, fluid to flow smoothly from the container. As mentioned above, the air opening may be associated with a channel formed by an indentation in the center panel. To create a more static flow and to prevent drippage from the air opening, the air channel may be further defined by a cover. The cover of one embodiment comprises a sticker that extends over at least a portion of the indentation and the air opening. The cover remains on the center panel when the portion of the sticker covering the fluid opening is removed therefrom. In one embodiment, the sticker and cover are made of the same material and is selectively severable, wherein the cover remains attached to the center panel when the majority of the sticker is removed from the center panel to expose the fluid opening. In one embodiment, the sticker is made of aluminum, which does not affect the integrity of the beverage stored within the container. In other embodiments, the sticker or the underside thereof includes a portion configured to contact the fluid stored within the container, while the remaining portions of the sticker are made of a different material, such as adhesive.

In another embodiment, the fluid opening and air opening are selectively sealed by a closure operatively interconnected to the end closure. For example, the container end closure of one embodiment employs a center panel having an outer track and an inner track located on either side of the fluid opening and the air opening. The closure employs corresponding rings that operatively engage respective tracks, which allows the closure to rotate freely around the end closure. The closure includes corresponding openings for fluid and air, wherein alignment of the fluid openings and air openings in the closure and the end closure allow for smooth fluid flow from the container.

It is one aspect of some embodiments of the present invention to provide a container, comprising: a container body configured to retain a fluid, the container body including an end closure having a first opening spaced from a second opening; a channel formed by a cover interconnected to an outer surface of the end closure and an indentation in the end closure positioned below the cover and associated with the second opening; and a selectively-removable member adhered to the end closure, the member comprising first end configured to cover the first opening and a second end configured to cover the second opening.

It is another aspect of some embodiments of the present invention to provide a container end closure, comprising: a center panel interconnected to a chuck wall, the chuck wall ending in a peripheral curl adapted to interconnect to a container sidewall; a fluid opening in the center panel; an indentation in the center panel spaced from the fluid opening; an air opening located in the indentation; a cover interconnected to an outer surface of the center panel and positioned over the air opening, the indentation and cover defining a channel; and a selectively-removable member adhered to the center panel, the member comprising first end configured to cover the fluid opening and a second end configured to cover the air opening.

It is still yet another aspect of some embodiments of the present invention to provide a container end closure, comprising: a center panel interconnected to a chuck wall, the chuck wall ending in a peripheral curl adapted to interconnect to a container sidewall; an outer track in the center panel following the outer periphery of the center panel adjacent to the chuck wall; an inner track in the center panel concentric with the outer track and spaced therefrom towards a center point of the center panel; a first fluid opening between the outer track and the inner track; an indentation in the center panel spaced from the fluid opening and located between the outer track and the inner track; a first air opening located in the indentation; a closure having an outer ring configured to operatively interconnect to the outer track, an inner ring spaced from the outer ring and configured to operatively interconnect to the inner track, and a second fluid opening and a second air opening positioned between the outer ring and the inner ring; and wherein the closure has a closed position of use wherein the closure blocks the first fluid opening and the first air opening and a second position of use wherein the first fluid opening and the second fluid opening are at least partially aligned and wherein the first air opening and the second air opening are at least partially aligned.

Those of ordinary skill in the art upon review of the embodiments shown and described herein related to containers, often associated with beverages, will appreciate that the reduced opening complexity will vastly reduce material costs. Further, modifications to existing container end closures used in the beverage arts, will not greatly alter existing container manufacturing and filling processes.

The Summary of the Invention is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present invention are possible utilizing, alone or in combination, as set forth above and/or described in the accompanying figures and/or in the description herein below.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and drawing figures are to be understood as being approximations which may be modified in all instances as required for a particular application of the novel assembly and method described herein.

The term "a" or "an" entity, as used herein, refers to one or more of that entity. As such, the terms "a" (or "an"), "one or more" and "at least one" can be used interchangeably herein. The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description and in the appended drawing figures.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
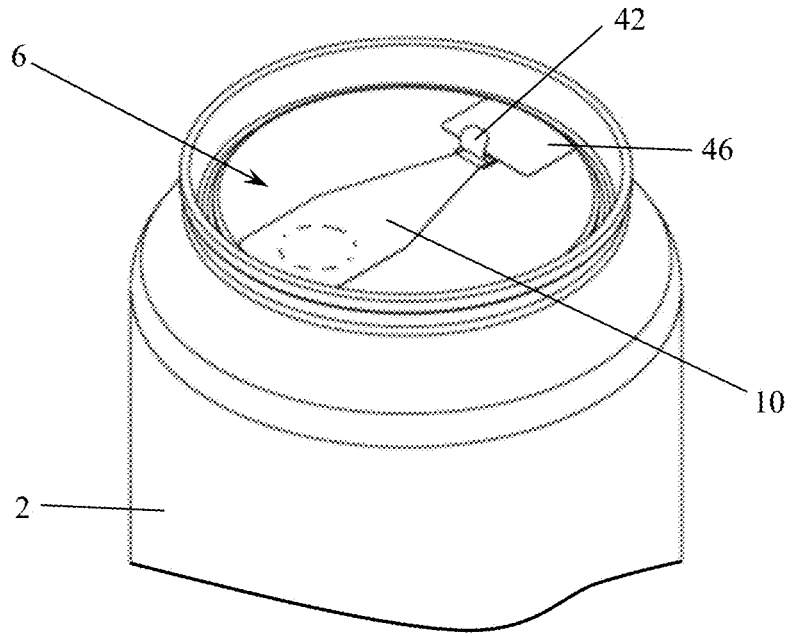
FIG. 1 is a perspective view showing a container end closure of one embodiment of the present invention that employs a selectively-removable member to seal a fluid opening.
Figure 2:
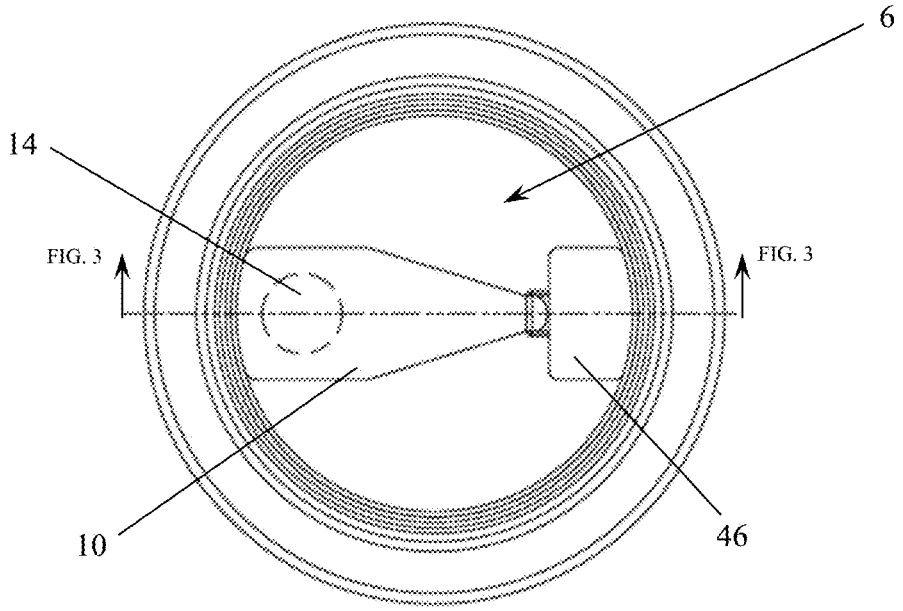
FIG. 2 is a top plan view of FIG. 1.

The following component list and associated numbering found in the drawings is provided to assist in the understanding of one embodiment of the present invention:

Component
2 Container
6 End closure
10 Sticker
14 Fluid opening
18 Center panel
22 Air opening
26 Air channel
30 Air
34 Fluid
38 Loop
42 Tab
46 Cover
56 Secondary sticker
60 Dimple
64 Wall
68 Foil panel
72 Opening
76 Perforation
80 Seal
102 Container
106 End closure
110 Flexible closure
114 Fluid opening
118 Center panel
122 Air opening
126 Air channel
138 Ring
Component
142 Head
146 Pocket
150 Track
154 Ramp
158 Bottom surface
162 Upper surface
202 Container
206 End closure
208 Riser
210 Closure
212 Grooves
214 Fluid opening
222 Air opening
242 Seal It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

One or more embodiments of the present invention include a pressure-equalizing device that allows fluid to be poured from a container while substantially equalizing air pressure within the container with atmospheric pressure. As a result, the fluid exits the container without the familiar glugging phenomena.

FIGS. 1-9 show a container 2 of one embodiment of the present invention that employs an end closure 6 with a selectively-removable sticker 10 that seals a fluid opening 14. More specifically, the end closure 6 includes the center panel 18 with the fluid opening 14 and an air opening 22 blocked by the sticker 10. Because the fluid opening 14 is often larger than the air opening 22, sticker 10 may be tapered to save material. That is, sticker 10 may have a first, wide end for covering the fluid opening 14 and a second, narrow end for blocking air opening 22.

Figure 9:
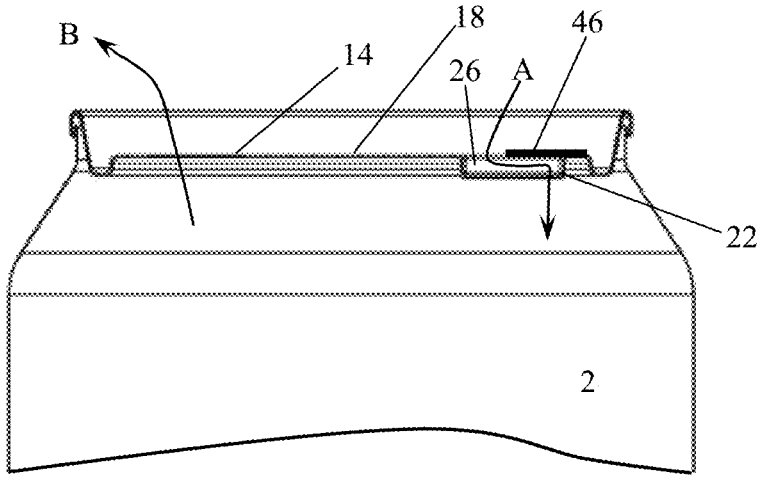
FIG. 9 is a cross-sectional view of FIG. 8.

An air channel 26 is also provided that allows air 30 to enter the container 22 in a direction of Arrow A while fluid 34 exits the container in the direction of Arrow B (see FIG. 9). Here, the air channel 26 is formed by an indentation in the container end and extends parallel to a plane defined by the end closure center panel 18. The second end of the sticker of one embodiment of the present invention employs a loop that seals at least a portion of the air channel 26 and blocks the air opening 22. As shown in detail in FIG. 7, a tab 42 is associated with the loop 38 that facilitates removal of the loop from the air channel 26 by providing the user with a gripping surface. Finally, a cover 46 is adhered to the center panel 18 and positioned over at least a portion of the loop 38, at least a portion of the air channel 26, and over the air opening 22. Accordingly, the side and bottom surfaces of the indentation and the underside of the cover 46 define the air channel 26, i.e., a tube, that communicates with the air opening as shown in FIG. 9.

Figure 3:
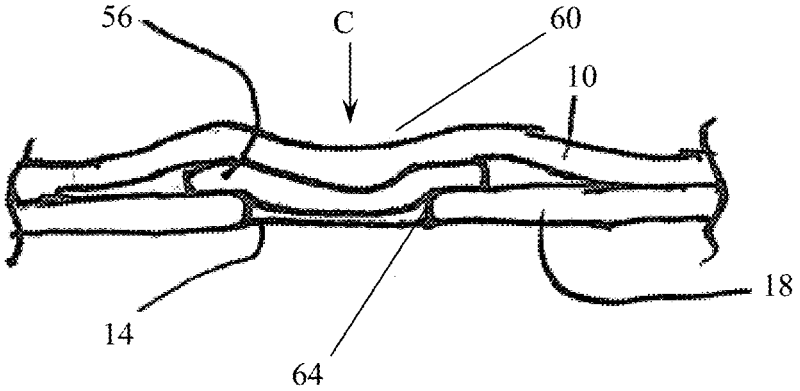
FIG. 3 is a partial cross-sectional view of FIG. 2.
Figure 4:
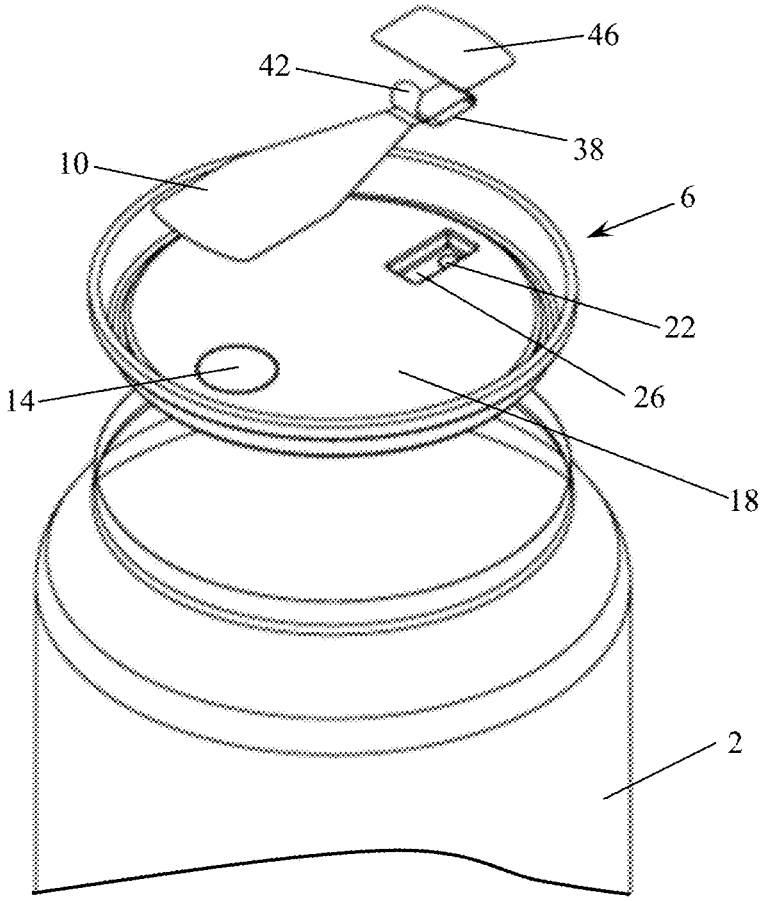
FIG. 4 is an exploded view of FIG. 1.
Figure 5:
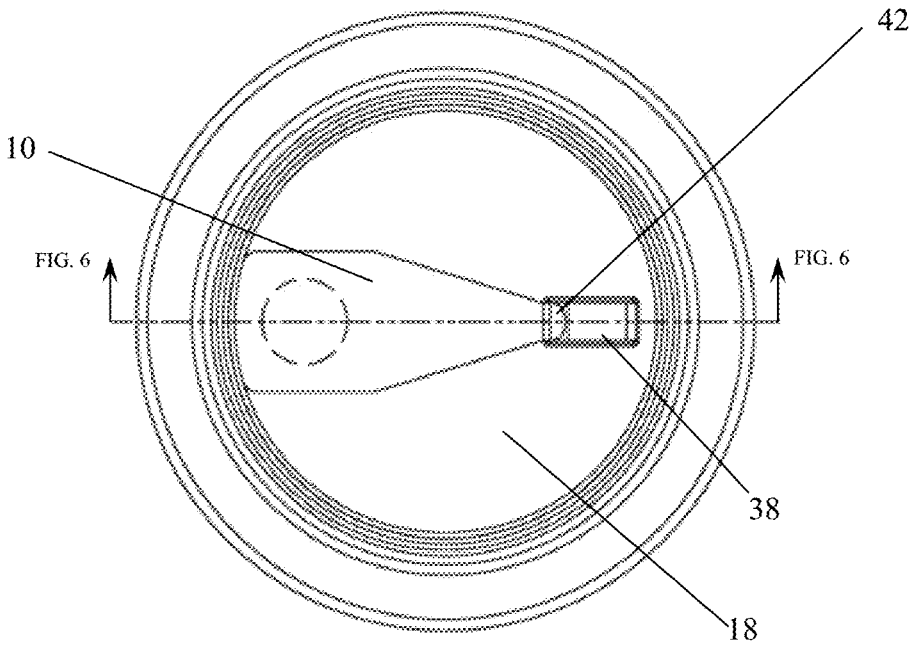
FIG. 5 is another top plan view of FIG. 1 wherein a cover has been removed for clarity.
Figure 6:
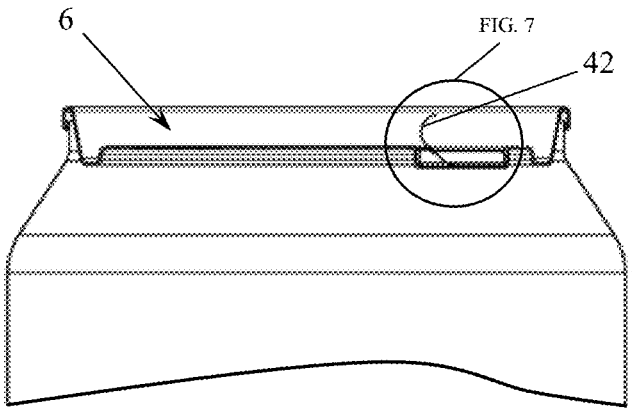
FIG. 6 is a cross-sectional view of FIG. 5.
Figure 7:
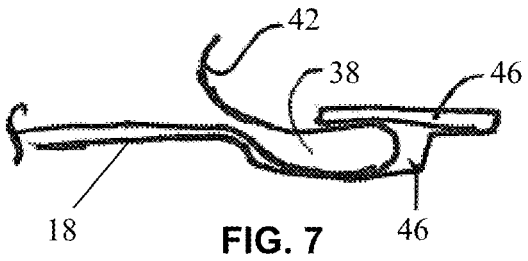
FIG. 7 is a detail view of FIG. 6.
Figure 8:
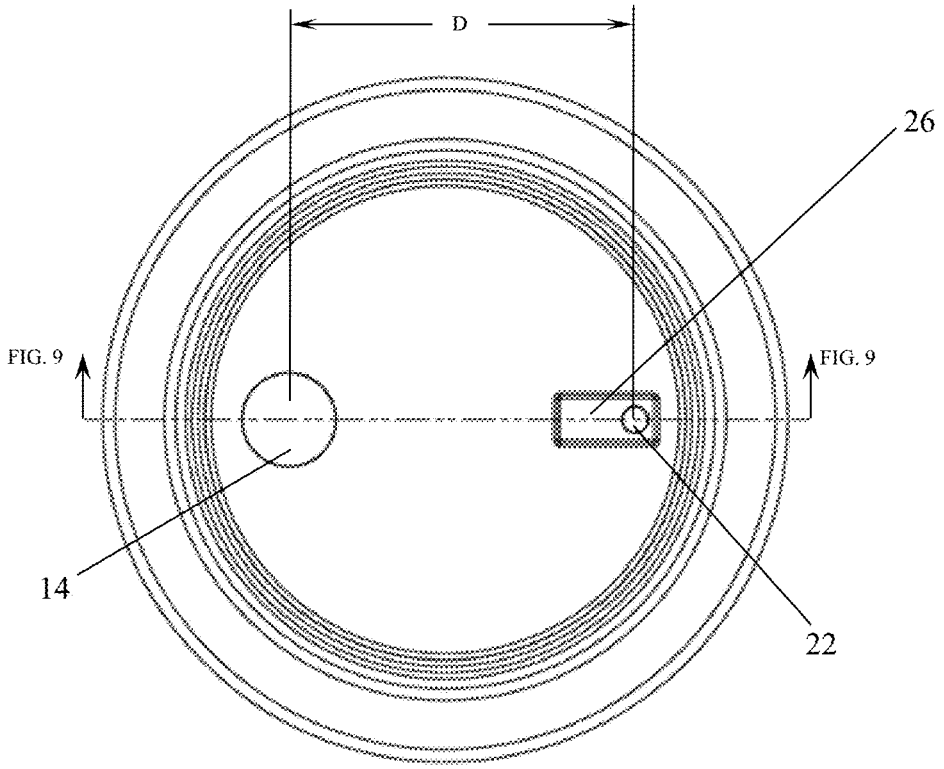
FIG. 8 is another top plan view of FIG. 1, wherein the selectively-removal member and cover had been removed for clarity.

FIG. 3 shows an alternative method of sealing the fluid opening 14. Here, a secondary sticker 56 is provided that seals the fluid opening 14. The secondary sticker 56 may have a foil underside to maintain the integrity of the fluid within the container. The secondary sticker 56 of one embodiment is selectively-removable member that interfaces with the fluid opening 14 with adhesive only about its outer periphery. The secondary sticker 56 is held in place by the primary sticker 10. In operation, the secondary sticker 56 is placed over the fluid opening 14 and a dimple 60 is created by an external force applied perpendicular to the center panel 18 in the direction of Arrow C. The dimple 60 engages portions of the secondary sticker 56 to a wall 64 in the center panel 18 that defines the fluid opening 14. One of ordinary skill in the art will appreciate that this configuration creates a tight fluid seal. The primary sticker 10 helps maintain the seal by effectively preventing the secondary sticker 56 from bowing outwardly in response to fluid pressure within the container, which could cause the outer edge of the secondary seal 56 to move within the outer periphery of the fluid opening 14, thereby circumventing the seal.

Figure 10:
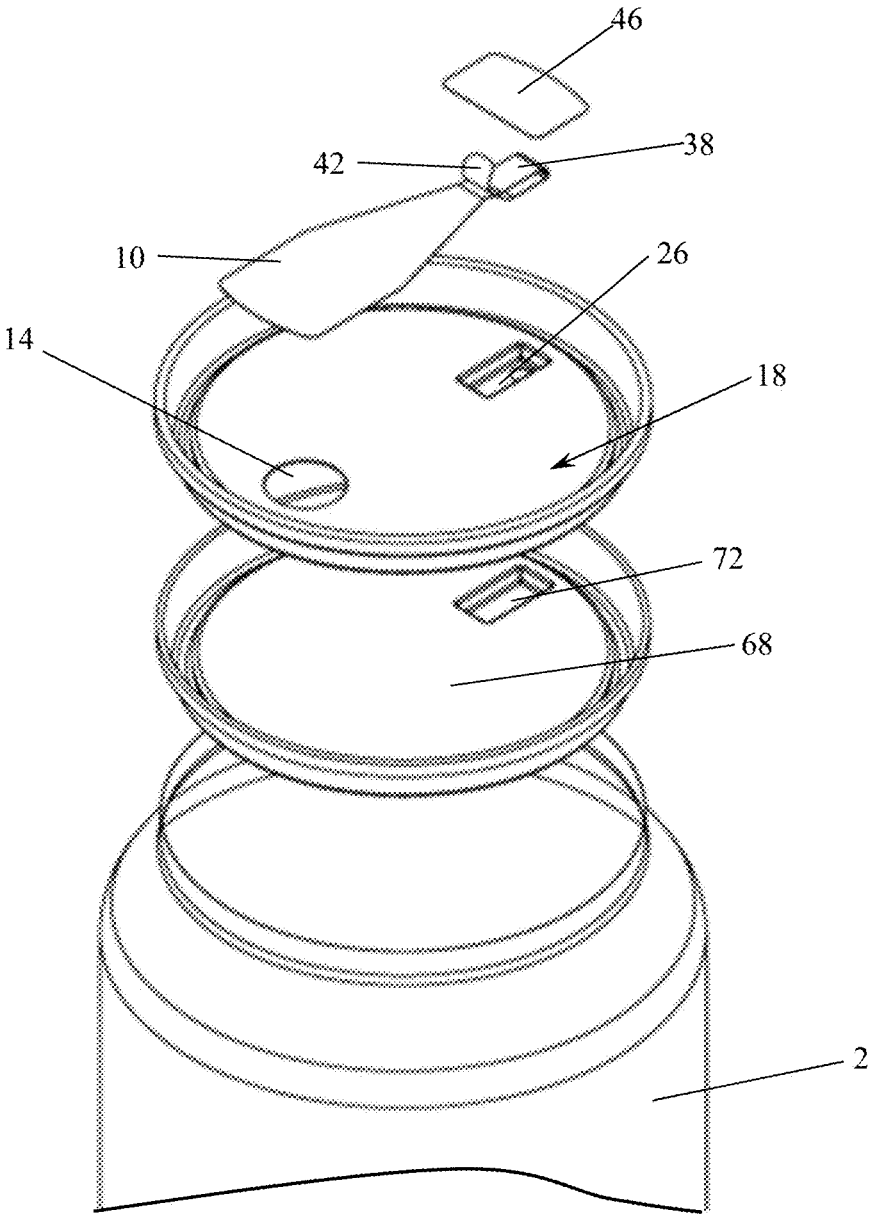
FIG. 10 is an exploded perspective view of another embodiment of the present invention that employs a selectively-removal member that covers a fluid opening.
Figure 11:
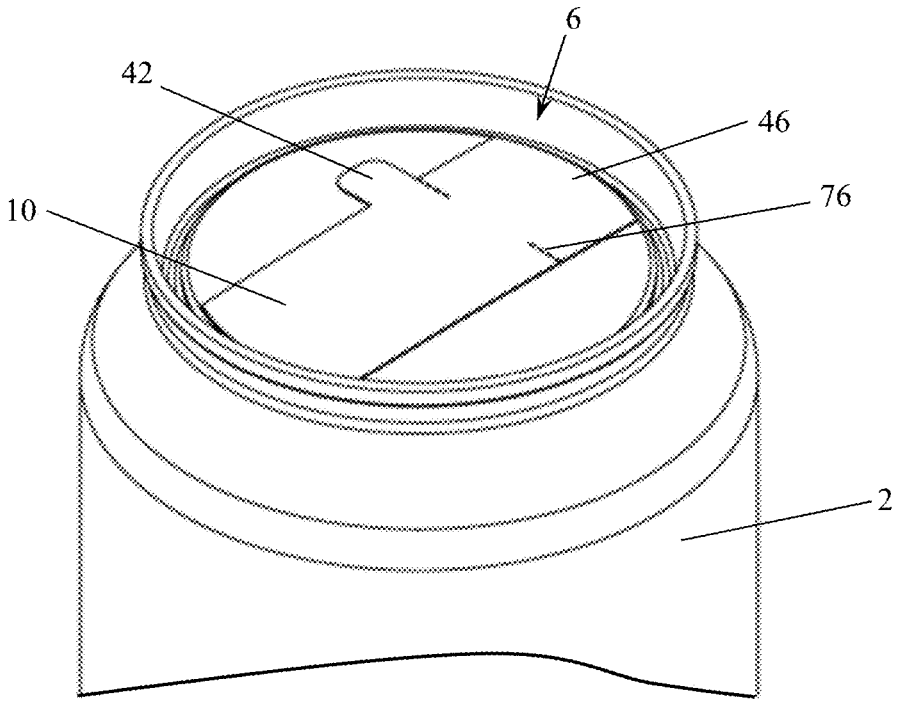
FIG. 11 is a perspective view of another embodiment of the present invention similar to that shown in FIG. 1.
Figure 12:
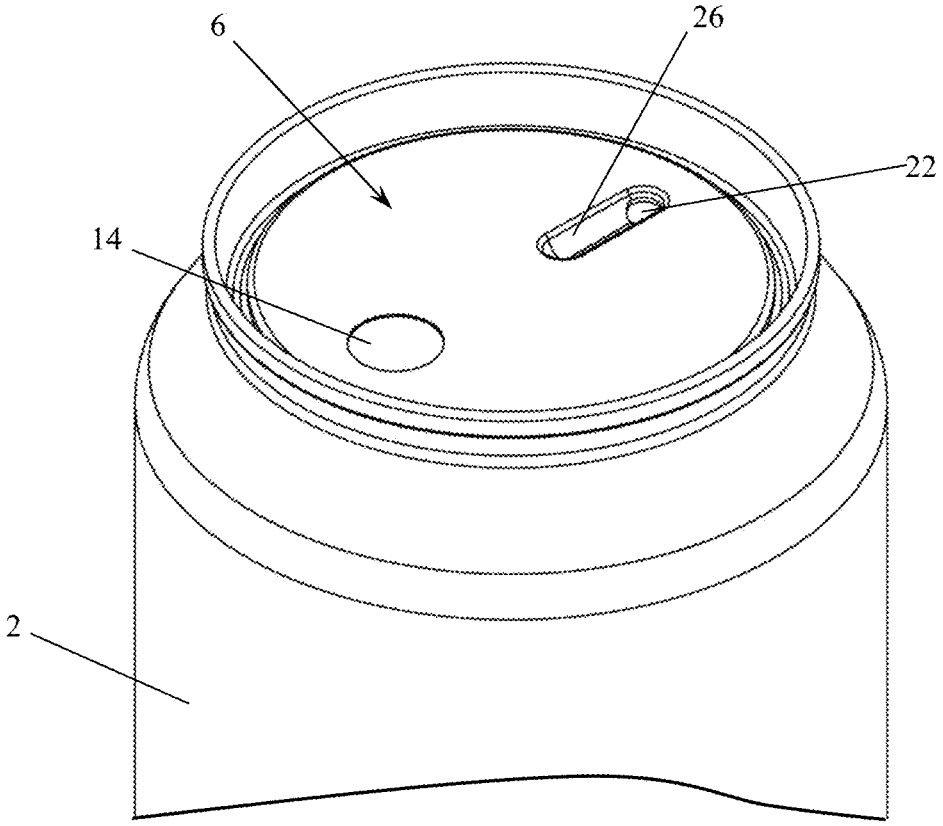
FIG. 12 is a perspective view of the embodiment shown in FIG. 11 wherein the selectively-removable member and cover have been removed for clarity.

As eluded to above, some embodiments of the present invention employ a sticker having a portion made of a material such as plastic or foil that directly contacts the pressurized fluid within the container, wherein the adhesive bond provided by the remainder of the sticker is sufficient to secure the sticker to the center panel and to maintain fluid pressure within the container. Alternatively, as shown in FIG. 10, a foil panel 68 is employed that engages the underside of the central panel 18. The foil panel 68 may have an opening 72 to accommodate the air channel 26 and air opening 22 as the internal fluid pressure at the air opening can normally be accommodated by the loop 38/cover 46 configurations described above. The fluid opening 14 of some end closures is large and, thus is blocked by the foil panel 68. In operation, the user breaks the foil by depressing the sticker 10 at the fluid opening before or after sticker removal. In other embodiments, removal of the sticker 10 removes and maintains a small foil disk from the foil panel 68. In this example, the foil panel 68 may employ micro-perforations in a location associated with the fluid opening 14 to facilitate removal of the foil disk when the sticker 10 is removed.

Figure 13:
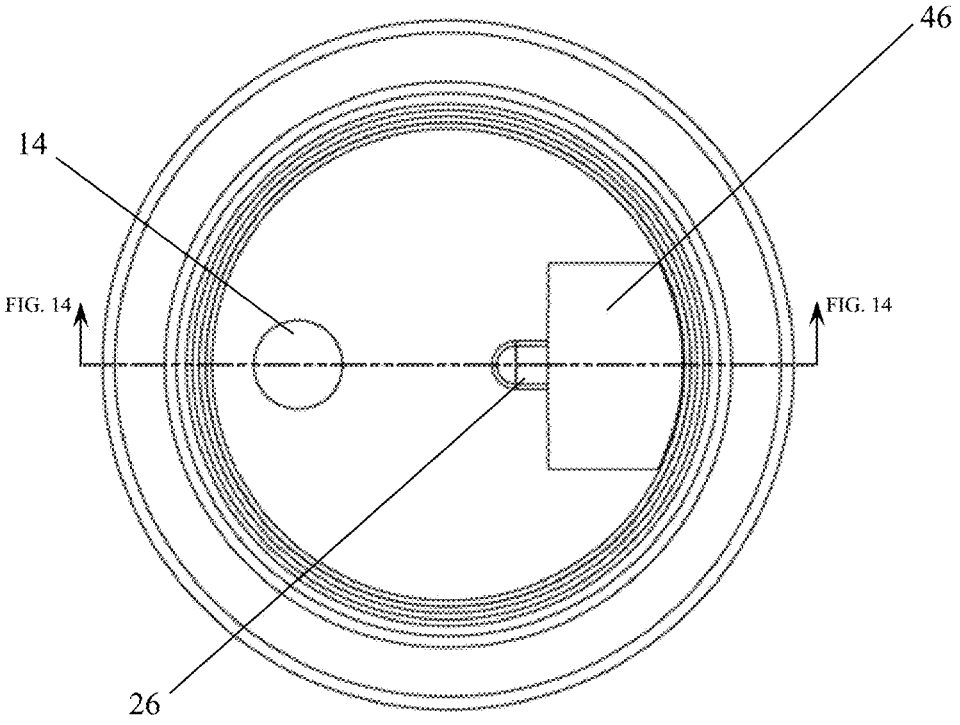
FIG. 13 is a top plan view of the embodiment shown in FIG. 11.
Figure 14:
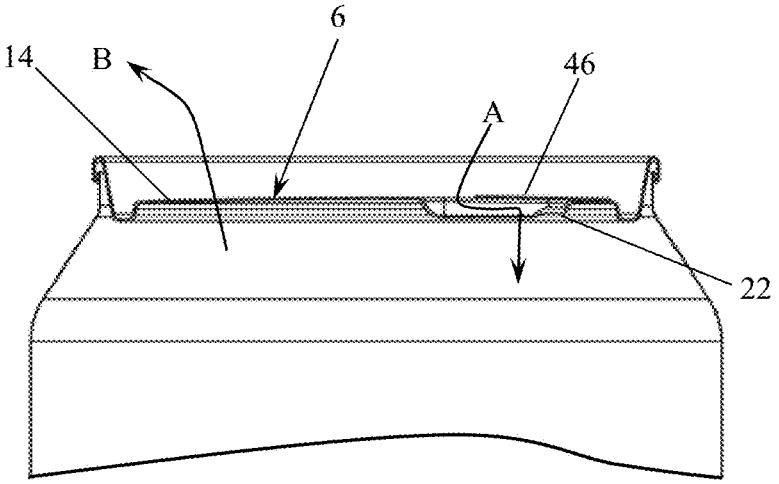
FIG. 14 is a cross-sectional view of FIG. 13.

FIGS. 11-14 show yet another embodiment of the present invention that employs an end closure 6 having a horizontally-oriented air channel 26. In the embodiment shown, the sticker 10 is interconnected to the end closure 6 and covers the fluid opening 14, air channel 26, and air opening 22. This embodiment is very similar to that shown in FIGS. 1-9, but wherein the sticker 10 and cover 46 are integrated. Here, the sticker has a tab 42 that facilitates removal of a portion thereof to expose a portion of the air channel 26 as shown in FIG. 13 while leaving another portion, i.e., the cover 46, in place. Separation of the sticker 10 may be facilitated by a perforation 76 provided between tab 42 and the cover 46. Again, the end closure 6 may include a foil backing panel that creates a secondary closure that must be removed by the user or which tears away when the sticker is removed, similar to the embodiment shown in FIG. 10. In operation, removal of the primary portion of the sticker 10 creates an air passage into the container defined by the cover 46 and walls of the air channel 26 that is created by the indentation into the end closure. Accordingly, air enters the container through the air channel 26 in the direction of Arrow A as fluid exits the fluid opening 14 in the direction of Arrow B. Those of skill in the art will appreciate that this embodiment and the embodiments described above may employ a plurality of fluid openings instead of the single opening shown.

Figure 15:
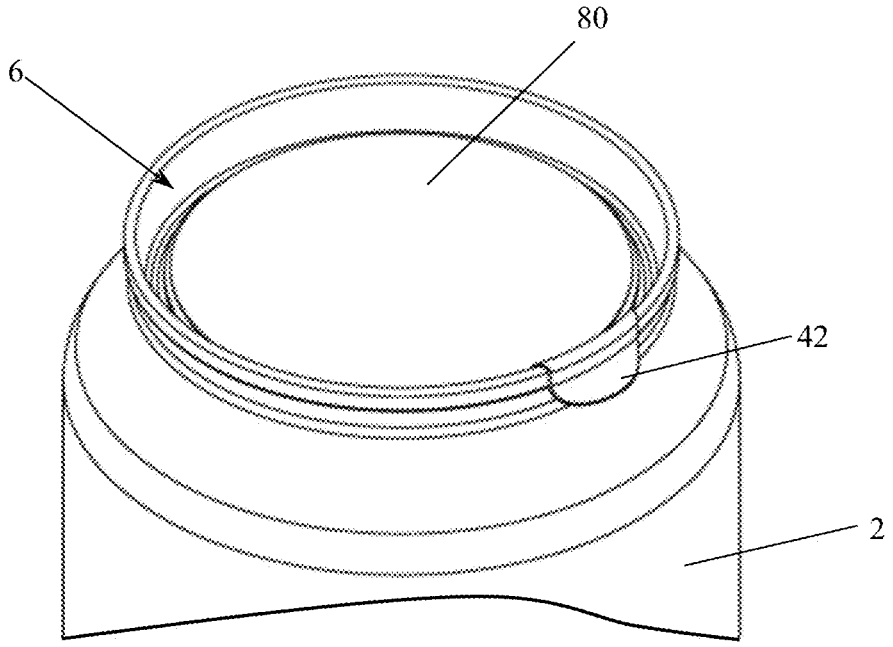
FIG. 15 is a perspective view of another embodiment of the present invention that employs a selectively-removable member the covers a fluid opening and an air opening in an end closure.
Figure 16:
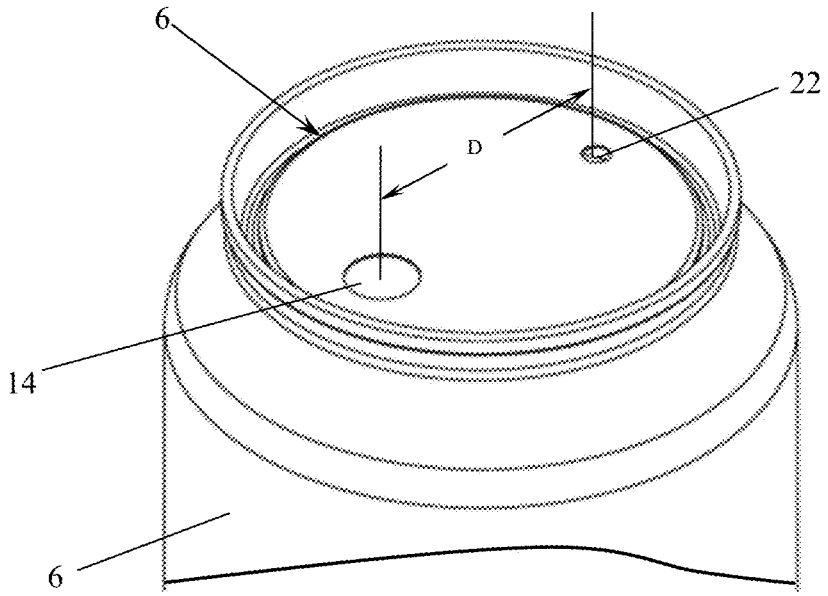
FIG. 16 is a perspective view showing the embodiment of FIG. 15 with the selectively-removable member removed.
Figure 17:
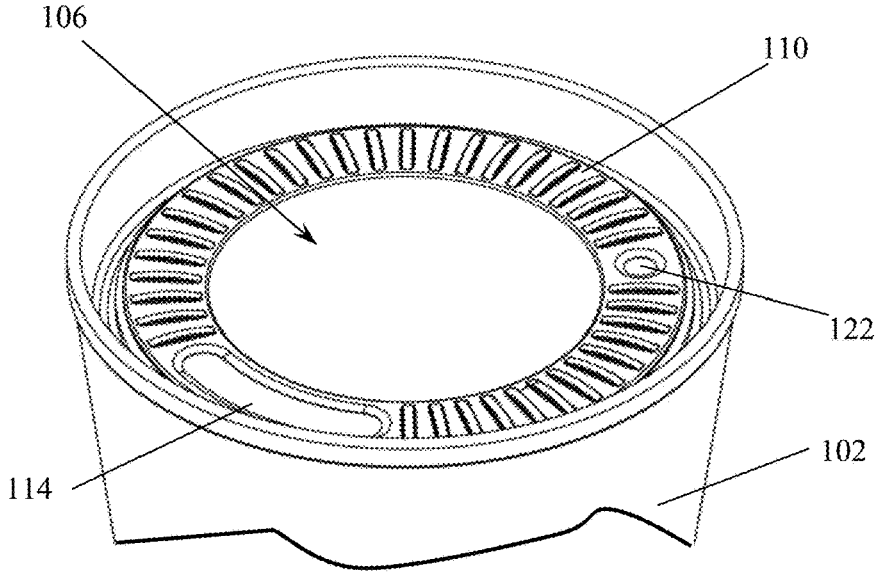
FIG. 17 is a resealable end closure of another embodiment of the present invention.
Figure 18:
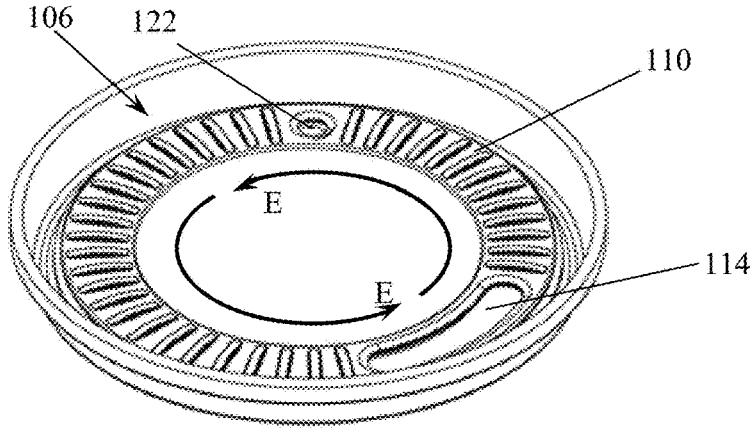
FIG. 18 is a top perspective view of the end closure shown in FIG. 17.
Figure 19:
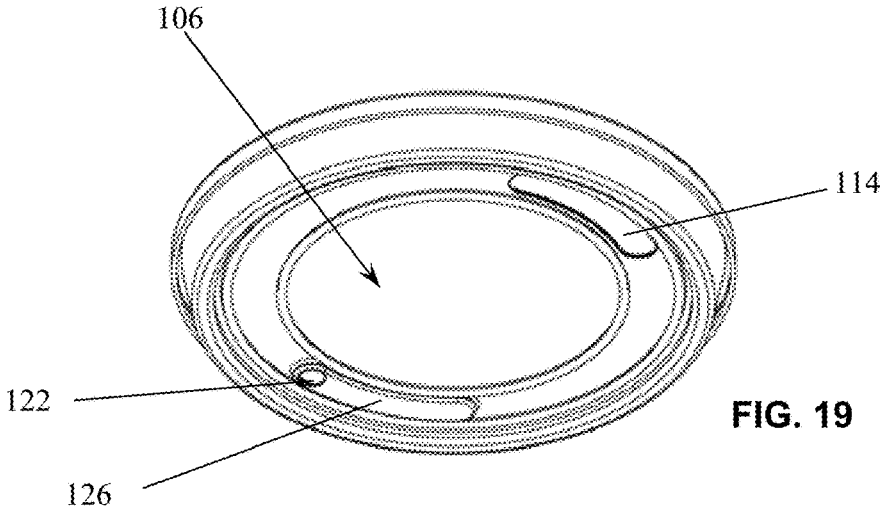
FIG. 19 is a bottom perspective view of the end closure shown in FIG. 17.

FIGS. 15 and 16 show another embodiment of the present invention similar to that shown in FIGS. 1-9, wherein an end closure 6 is provided having a fluid opening 14 spaced from an air opening 22 a predetermined distance (D), which may be critical to ensure a smooth pour from the container. Here, a seal 80 that covers the majority of the end closure 6 is provided. The seal 80 is adhered to the end closure 6 and may include a tab 42 to facilitate removal thereof. The entirety or portion of the seal 80 may be made of a material that does not affect the contents of the container 2, wherein fluid pressure at the fluid opening is directly in contact with the seal. Alternatively, a foil panel (not shown) may be positioned on the underside of the end closure that must be punctured near the fluid opening to allow fluid to escape from the container as in some of the embodiments described above. Ideally, the area under the air opening 22 is free of foil, wherein the seal 80 maintains pressure at that location. The air opening 22 may be associated with a tube that extends into the container. Also, as described above, the seal 80 may selectively remove a small foil disk associated with the fluid opening when the seal 80 is removed from the end closure 6.

Although the foregoing describes the use of "stickers" or "adhesives" to selectively interconnect a sealing member(s), or associated components, to a container end closure, those of skill in the art should appreciate that other methods of selective attachment may be employed without departing from the scope of the invention. For example, heat sealing, radio frequency welding, ultrasonic welding, friction stir welding, or any similar method may be used. Further, a peelable coating may be used, which may allow for the omission of a separate sealing member, i.e., a sticker, or foil to protect the contents of the container.

FIG. 17-25 show a reclosable container end 106 suited for interconnection to a contaner 102, such as cup, e.g., a coffee cup, or a beverage can. One of ordinary skill in the art will appreciate that the features described with respect to this embodiment can be used on other container types without departing from the scope of the invention. A flexible closure 110 is provided that employs downwardly-extending rings 138. The rings possess bulbous heads 142 that fit within corresponding pockets 146 of tracks 150 found in the end closure 106. Once interconnected, removal of the closure 110 is prevented because the tracks 150 narrow near the container end's center panel 118. One method of manufacturing comprises forming tracks 150 of constant width in the center panel 118 that receive corresponding rings 138 (with bulbous heads) extending from the closure 110. Thereafter, a forming operation is performed to narrow portions of the tracks 150 adjacent to the center panel 118, thereby creating the pockets 146 and trapping the heads 142. The closure 110 is able to rotate relative to the container (see, Arrow E in FIG. 18) end closure 110 but not escape therefrom.

Figure 20:
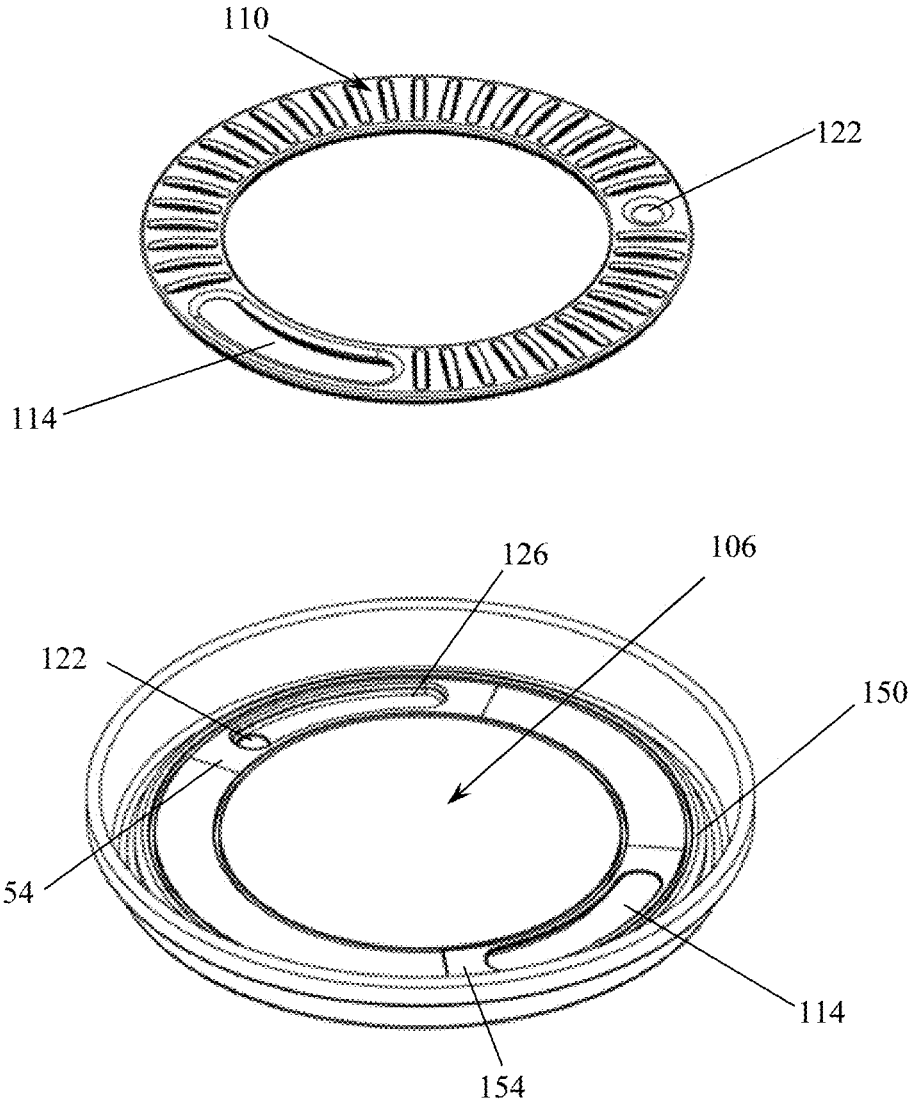
FIG. 20 is an exploded view of the end closure shown in FIG. 17.
Figure 22:
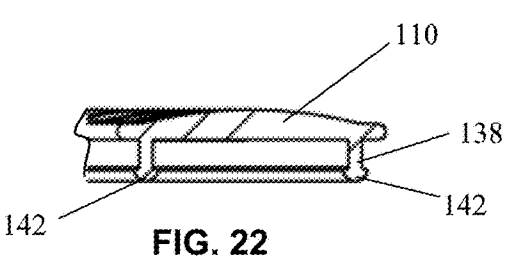
FIG. 22 is a detailed view of FIG. 21.
Figure 23:
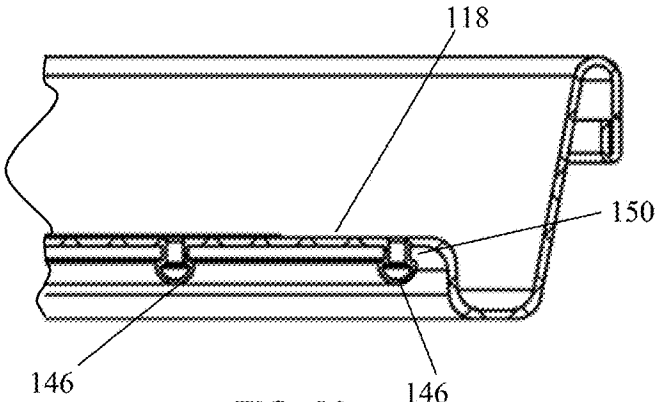
FIG. 23 is a detailed view of FIG. 21.
Figure 24:
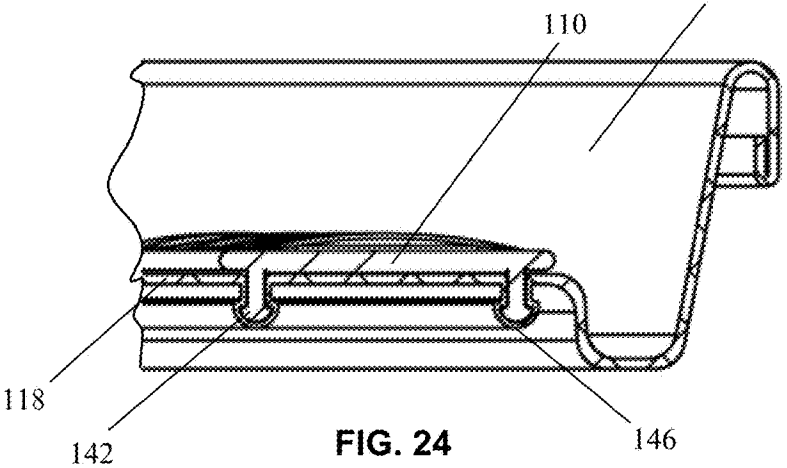
FIG. 24 is a detailed view of FIG. 21.
Figure 21:
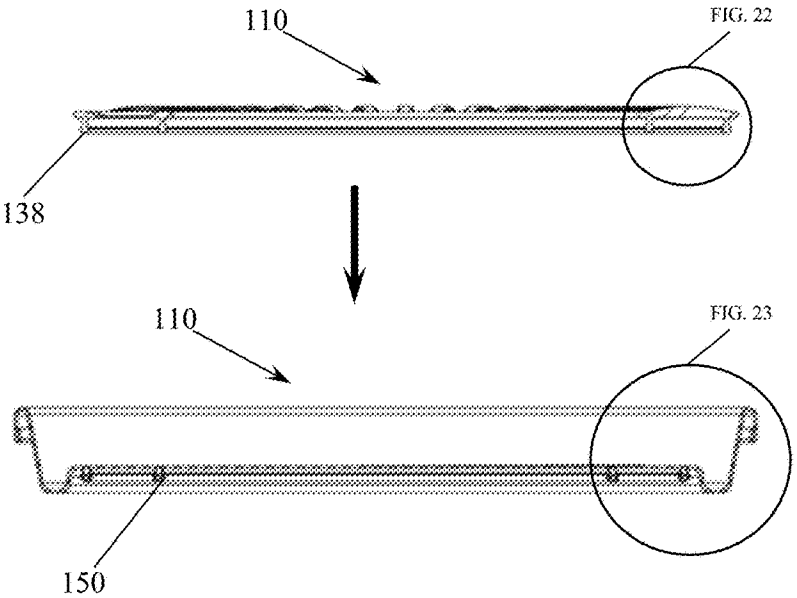
FIG. 21 is an exploded cross-sectional view of the end closure shown in FIG. 17.
Figure 21:
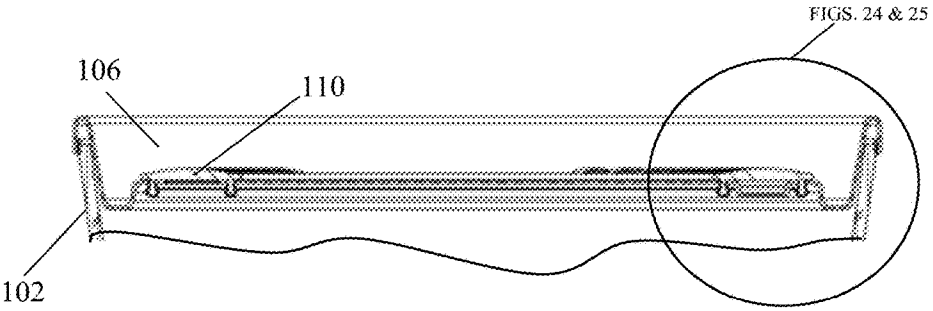
Figure 25:
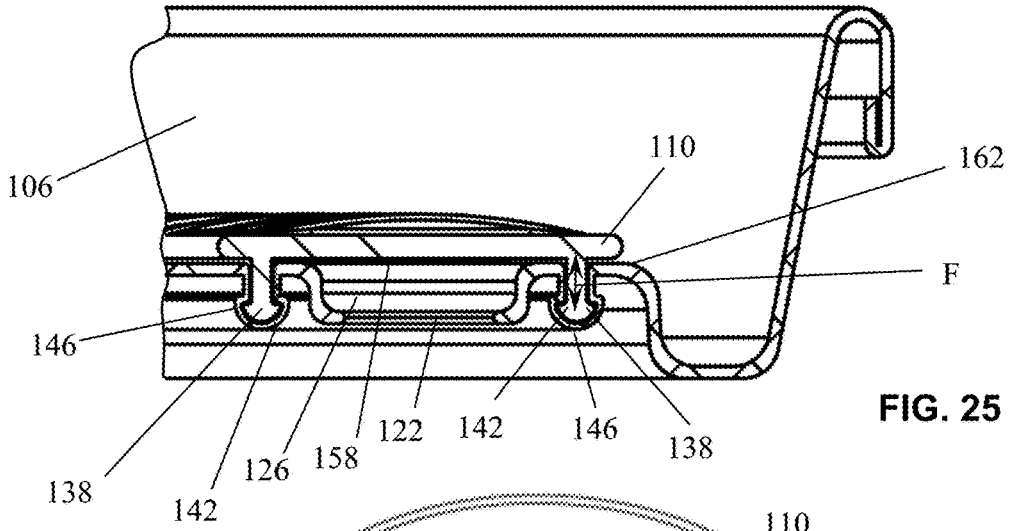
FIG. 25 detailed view of the resealable end closure shown in FIG. 17.
Figure 26:
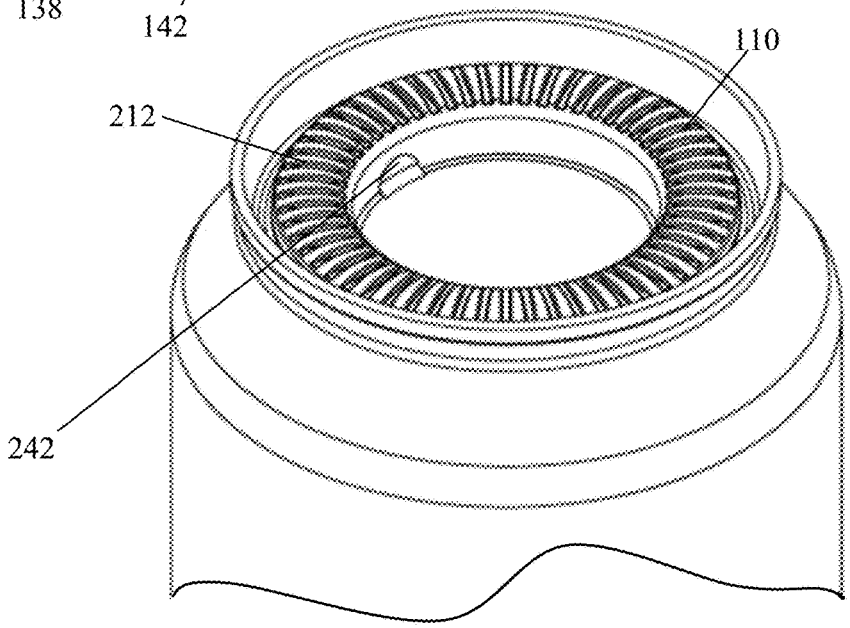
FIG. 26 is a perspective view of a resealable end closure of another embodiment of the present invention.
Figure 27:
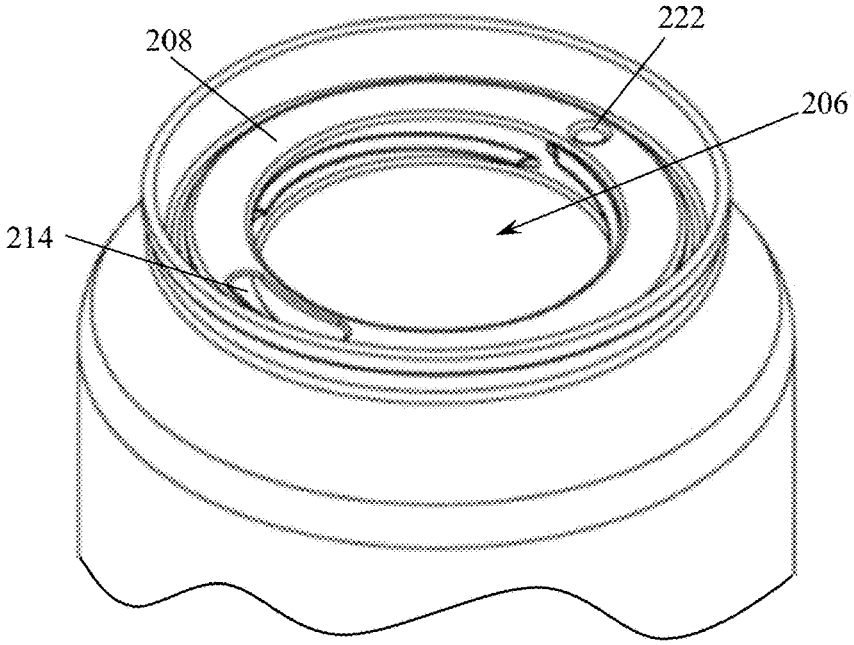
FIG. 27 is a perspective view of the end closure shown in FIG. 26, wherein a closure portion has been removed for clarity.

As shown in FIG. 20, the end closure 106 employs ramps 154 on either side of fluid and air openings 114/122. The ramps 154 are generally formed of thicker or deformed portions of the center panel 118 configured to interact with the bottom surface 158 of the closure 110 as it is rotated. FIG. 25 illustrates how the ramps increase the distance between the pockets 146 and the upper surface 162 of the center panel 118 adjacent to an air channel 126 and fluid opening 114, which stretches the flexible rings 118 extending from the closure 110. An equal and opposite force is created within the rings (shown by Arrow F that urge the closure 110 into tight engagement with the material of the center panel surrounding the air channel 126 and the fluid opening 114. The seal is enhanced by the serpentine path created between the pockets and the rings. Although this embodiment shows tracks formed within the center panel, one of ordinary skill in the art will appreciate that the center panel may include outwardly-extending rings received by corresponding tracks incorporated into the end closure.

FIGS. 26-29 show a resealable end closure 206 of yet another embodiment of the present invention. Here, the end closure 206 employs a riser 208 that operatively receives a closure 210. The closure 210 may have a plurality of grip-enhancing grooves 212 that help users rotate the closure as it travels on the riser 208. A seal 242 may be provided that interconnects a portion of the closure the end closure 206. In this example, rotation of the closure 210 will tear or otherwise alter the seal 242, which is an indication that the container 202 has been open.

Figure 28:
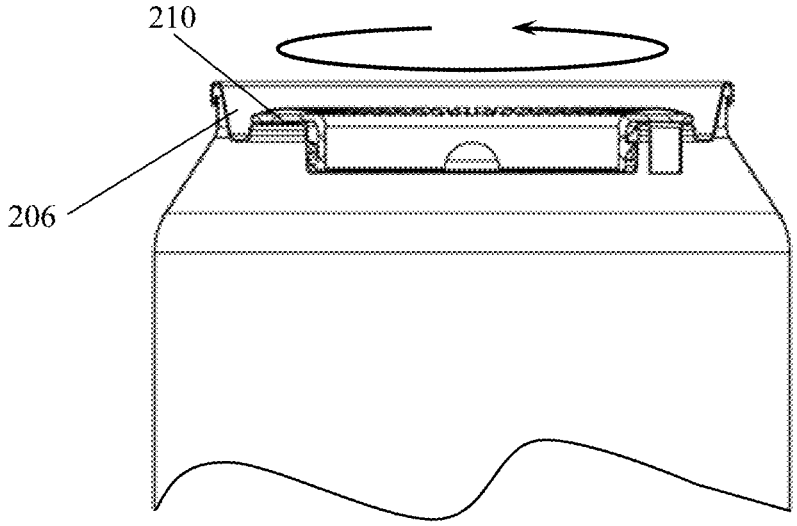
FIG. 28 is a cross-sectional view of the end closure shown in FIG. 26, wherein the closure portion is in a sealed position of use.
Figure 29:
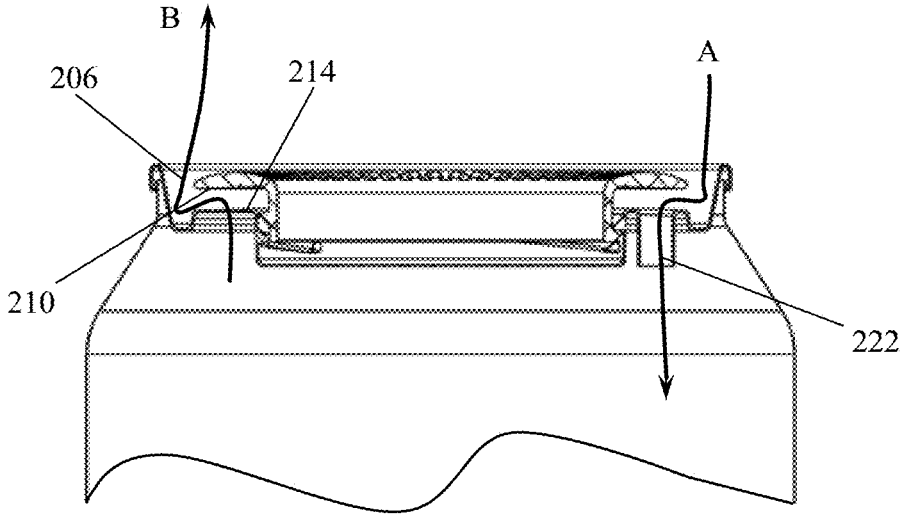
FIG. 29 is a cross-sectional view of the end closure shown in FIG. 26, wherein the closure portion is in an open position of use.

The end closure 206 has a portion within the riser that is bound by a floor that extends into the container. This portion also has threads or tracks to receive an annular protrusion extending from a complementary portion of the closure. Accordingly, when the closure is rotated, interaction between the annular protrusion and the threads move the closure upwardly or downwardly depending on the direction of rotation. Movement of the closure upwardly opens the container as shown in FIG. 29 and movement of the closure in the opposite direction closes the container as shown in FIG. 28. The closure may have sealing material on a lower surface thereof that engages a fluid opening 214 and air opening 222 of the end closure to maintain the integrity of the fluid within the container. The end closure also may employ an air tube that extends into the container that prevents fluid egress while allowing air ingress. Those of ordinary skill in the art will appreciate that the tube may be replaced with other means that provides this function.

As alluded to above, the riser of the end closure includes a fluid opening and an air opening, similar to the embodiments described above. Again, the distance between the fluid opening and the air opening may be critical in some embodiments of the present invention to provide smooth flow from the container while preventing fluid egress from the air opening. With specific reference to FIGS. 28 and 29, operation of one embodiment of the present invention can be appreciated. Here, rotation of the closure in one direction separates the bottom surface of the closure for the top surface of the riser. The thread/annular protrusion configuration is designed to ensure a tight seal between the closure and the riser once closed and prevents over-rotation of the closure such that it stays on the container. Separating the closure from the riser opens a fluid opening and air opening, wherein tilting the container will allow fluid to exit the container. The fluid will exit smoothly from the container and onto the end closure and associated countersink. Rotation of the closure in an opposite direction will again engage the bottom surface of the closure to the top surface of the riser, thereby sealing the container.Exemplary characteristics of embodiments of the present invention have been described. However, to avoid unnecessarily obscuring embodiments of the present invention, the preceding description may omit several known apparatus, methods, systems, structures, and/or devices one of ordinary skill in the art would understand are commonly included with the embodiments of the present invention. Such omissions are not to be construed as a limitation of the scope of the claimed invention. Specific details are set forth to provide an understanding of some embodiments of the present invention. It should, however, be appreciated that embodiments of the present invention may be practiced in a variety of ways beyond the specific detail set forth herein.

Modifications and alterations of the various embodiments of the present invention described herein will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. That is, the embodiments of the invention described herein are capable of being practiced or of being carried out in various ways. The scope of the various embodiments described herein is indicated by the following claims rather than by the foregoing description. And all changes which come within the meaning and range of equivalency of the claims are to be embraced within their scope. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The foregoing disclosure is not intended to limit the invention to the form or forms disclosed herein. In the foregoing Detailed Description, for example, various features of the invention are grouped together in one or more embodiments for the purpose of streamlining the disclosure. This method of disclosure is not to be interpreted as reflecting an intention that the claimed inventions require more features than expressly recited. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention. Further, the embodiments of the present invention described herein include components, methods, processes, systems, and/or apparatus substantially as depicted and described herein, including various sub-combinations and subsets thereof. Accordingly, one of skill in the art will appreciate that would be possible to provide for some features of the embodiments of the present invention without providing others. Stated differently, any one or more of the aspects, features, elements, means, or embodiments as disclosed herein may be combined with any one or more other aspects, features, elements, means, or embodiments as disclosed herein.

What is claimed is:

1. A container, comprising:

a container body configured to retain a fluid, the container body including an end closure having a first opening spaced from a second opening;

a channel formed by a cover interconnected to an outer surface of the end closure and an indentation in the end closure positioned below the cover and associated with the second opening; and a selectively-removable member adhered to the end closure, the member comprising first end configured to cover the first opening and a second end configured to cover the second opening;

wherein the second end of the selectively-removable member includes a portion configured for selective insertion into the channel that blocks the second opening, the portion ending in a tab configured to extend out of the channel, wherein the tab is used to remove the portion of the second end from the channel while leaving the cover in place.

2. The container of claim 1, wherein the channel is a generally rectangular-shaped indentation comprising a first end wall adj acent to the second opening and a second end wall that extends towards the first opening, wherein the cover is positioned over the second end.

3. The container of claim 1, wherein the selectively-removable member is interconnected to the end closure by way of an adhesive, a heat seal, a radio frequency weld, an ultrasonic weld, or a friction stir weld.

4. The container of claim 1, wherein the selectively-removable member is comprised of a pealable coating.

5. A container end closure, comprising:

a center panel interconnected to a chuck wall, the chuck wall ending in a peripheral curl adapted to interconnect to a container sidewall;

a fluid opening in the center panel;

an indentation in the center panel spaced from the fluid opening;

an air opening located in the indentation;

a cover interconnected to an outer surface of the center panel and positioned over the air opening, the indentation and cover defining a channel; and a selectively-removable member adhered to the center panel, the member comprising first end configured to cover the fluid opening and a second end configured to cover the air opening.

6. The end closure of claim 5, wherein the channel is a generally rectangular-shaped indentation comprising a first end wall adjacent to the air opening and a second end wall that extends towards the fluid opening.

7. The end closure of claim 5, wherein the second end of the selectively-removable member includes a portion configured for selective insertion into the channel and to block the fluid opening, the portion ending in a tab configured to extend out of the channel, wherein the tab is used to remove the portion of the second end from the channel while leaving the cover in place.

8. The end closure of claim 5, wherein the selectively-removable member is selectively interconnected to the center panel by way of an adhesive, a heat seal, a radio frequency weld, an ultrasonic weld, or a friction stir weld.

9. The end closure of claim 5, wherein the selectively-removable member is interconnected to the cover, wherein removal of the selectively-removable member from the end closure leaves at least a portion of the cover interconnected to the center panel and positioned over the air opening.

10. The end closure of claim 5, wherein the selectively-removable member is comprised of a pealable coating.

11. The container of claim 5, further comprising a foil layer interconnected to a bottom surface of the end closure.

12. The end closure of claim 11, wherein the foil layer includes a removable portion defined by a plurality of perforations that generally correspond to the outer periphery of the fluid opening, wherein removal of the selectively-removable member from the center panel removes at least a portion of the removable portion from the foil layer.

13. A container, comprising:

a container body configured to retain a fluid, the container body including an end closure having a first opening spaced from a second opening;

a channel formed by a cover interconnected to an outer surface of the end closure and an indentation in the end closure positioned below the cover and associated with the second opening;

a selectively-removable member adhered to the end closure, the member comprising first end configured to cover the first opening and a second end configured to cover the second opening; and wherein the selectively-removable member is interconnected to the cover, wherein removal of the selectively-removable member from the end closure leaves at least a portion of the cover interconnected to the end closure and positioned over the second opening.

14. The container of claim 13, wherein the channel is a generally rectangular-shaped indentation comprising a first end wall adj acent to the second opening and a second end wall that extends towards the first opening, wherein the cover is positioned over the second end.

15. The container of claim 13, wherein the selectively-removable member is interconnected to the end closure by way of an adhesive, a heat seal, a radio frequency weld, an ultrasonic weld, or a friction stir weld.

16. The container of claim 13, wherein the selectively-removable member is comprised of a pealable coating.

* * * * *